US011415136B2

(12) United States Patent
Takaki et al.

(10) Patent No.: US 11,415,136 B2
(45) Date of Patent: Aug. 16, 2022

(54) SCREW COMPRESSOR

(71) Applicant: KOBE STEEL, LTD., Hyogo (JP)

(72) Inventors: Shugo Takaki, Takasago (JP); Yasushi Amano, Takasago (JP); Hirofumi Saito, Takasago (JP); Masato Hayashi, Takasago (JP)

(73) Assignee: KOBE STEEL, LTD., Hyogo (JP)

( * ) Notice: Subject to any disclaimer, the term of this patent is extended or adjusted under 35 U.S.C. 154(b) by 204 days.

(21) Appl. No.: 16/436,418

(22) Filed: Jun. 10, 2019

(65) Prior Publication Data

US 2019/0390671 A1 Dec. 26, 2019

(30) Foreign Application Priority Data

Jun. 22, 2018 (JP) ..... JP2018-118586

(51) Int. Cl.
*F04C 29/04* (2006.01)
*F04C 18/16* (2006.01)

(52) U.S. Cl.
CPC ..... *F04C 29/042* (2013.01); *F04C 18/16* (2013.01); *F04C 29/04* (2013.01)

(58) Field of Classification Search
CPC .... F04B 39/0207; F04B 39/06; F04D 29/584; F04C 29/04; F04C 15/0096; F04C 18/16; F04C 29/02; F04C 29/026; F04C 29/021; F04C 2240/809; F01C 21/04
See application file for complete search history.

(56) References Cited

U.S. PATENT DOCUMENTS 3,945,219 A * 3/1976 Kasahara ..... F04C 29/045 62/469
4,394,113 A * 7/1983 Bammert ..... F04C 29/02 418/201.2
4,727,725 A 3/1988 Nagata et al.
6,116,046 A * 9/2000 Leaver ..... F04C 28/28 62/192
6,205,808 B1 * 3/2001 Beekman ..... F04C 28/28 418/DIG. 1
2009/0191082 A1 7/2009 Yoshimura et al.
(Continued)

FOREIGN PATENT DOCUMENTS

EP 0030619 A1 6/1981
EP 2306027 A1 * 4/2011 ..... F04C 18/16
(Continued)

OTHER PUBLICATIONS

The extended European search report issued by the European Patent Office dated Sep. 11, 2019, which orresponds to EP19178938.7-1004 and is related to U.S. Appl. No. 16/436,418.

*Primary Examiner* — Nathan C Zollinger
(74) *Attorney, Agent, or Firm* — Studebaker & Brackett. PC

(57) ABSTRACT

Provided is a screw compressor including a screw rotor configured to compress a gas due to rotation of the screw rotor about an axis of the screw rotor and a casing housing the screw rotor rotatably and provided with a suction port for a gas, the casing being provided with a suction side space through which a gas flowing into the casing from the suction port and not yet sucked by the screw rotor flows. The casing is provided with a heating fluid passage for introducing a heating fluid into the suction side space so as to heat oil staying in the suction side space.

11 Claims, 13 Drawing Sheets

(56) References Cited

U.S. PATENT DOCUMENTS

| | | | | |
|---|---|---|---|---|
| 2011/0076174 | A1 | 3/2011 | Kakiuchi et al. | |
| 2012/0237382 | A1* | 9/2012 | Yoshimura | H02K 9/19 418/98 |
| 2016/0215777 | A1 | 7/2016 | De Schamphelaere | |
| 2016/0327045 | A1 | 11/2016 | Coeckelbergs et al. | |
| 2022/0090597 | A1* | 3/2022 | Rosinski | F04C 11/008 |

FOREIGN PATENT DOCUMENTS

| | | | | |
|---|---|---|---|---|
| EP | 2306027 | A1 | | 4/2011 |
| JP | 09287580 | A | * | 11/1997 |
| JP | 10159764 | A | * | 6/1998 |
| JP | 2001-065795 | A | | 3/2001 |
| JP | 2003-227469 | A | | 8/2003 |
| JP | 2011-196272 | A | | 10/2011 |
| JP | 2012-097645 | A | | 5/2012 |
| WO | 2015/035478 | A1 | | 3/2015 |

* cited by examiner

SCREW COMPRESSOR

TECHNICAL FIELD

The present invention relates to a screw compressor.

BACKGROUND ART

Conventionally, as disclosed in JP 2001-65795 A (Patent Literature 1), there has been known a screw compressor which includes a pair of male and female screw rotors. In the screw compressor, the male rotor and the female rotor are arranged so as to mesh with each other in a casing. A pressure of a gas is increased to a predetermined pressure by rotating both rotors around an axis of the rotors.

Patent literature 1 discloses a boil-off gas processing apparatus which increases a pressure of a boil-off gas generated in a tank of a liquefied natural gas (LNG) to a predetermined supply pressure and supplies the boil-off gas to a demander, wherein the screw compressor is used for increasing a pressure of the boil-off gas. In this patent literature, a heat exchanger is disposed in a middle portion of a path introducing the boil-off gas into the screw compressor so that the boil-off gas before being introduced into the compressor can be heated by the heat exchanger. The screw compressor disclosed in the patent literature is an oil-cooled screw compressor to which oil is supplied mainly for eliminating heat generated by compression.

In the oil-cooled screw compressor disclosed in Patent Literature 1, when a gas of an ultra-low temperature (approximately −160° C.) such as the boil-off gas generated in the LNG tank is introduced into the screw compressor, there is a case where oil in the casing is extremely cooled so that the oil is frozen. As a result, there is a case where the rotation of a screw rotor in the casing is obstructed so that a normal running operation of the compressor is obstructed. To cope with such a case, Patent Literature 1 discloses the configuration where the boil-off gas before being introduced into the compressor is heated in advance by the heat exchanger. In this case, however, it is impossible to avoid the occurrence of a situation where a facility becomes complicated due to mounting of the heat exchanger.

SUMMARY OF INVENTION

It is an object of the present invention to provide a screw compressor capable of preventing freezing of oil in a casing even when the screw compressor is used for compressing a low temperature gas, while preventing a facility from becoming complicated in a path for introducing the gas into the compressor.

According to an aspect of the present invention, a screw compressor includes a screw rotor configured to compress a gas due to rotation of the screw rotor about an axis of the screw rotor and a casing housing the screw rotor rotatably and provided with a suction port for a gas, the casing being provided with a suction side space through which a gas flowing into the casing from the suction port and not yet sucked by the screw rotor flows. The casing is provided with a heating fluid passage for introducing a heating fluid to the suction side space so as to heat oil staying in the suction side space.

According to the present invention, it is possible to provide a screw compressor capable of preventing freezing of oil in a casing even when the screw compressor is used for compressing a low temperature gas, while preventing a facility from becoming complicated in a path for introducing the gas into the compressor.

DESCRIPTION OF EMBODIMENTS

Hereinafter, embodiments of the present invention are described in detail with reference to drawings.

First Embodiment

Figure 1:
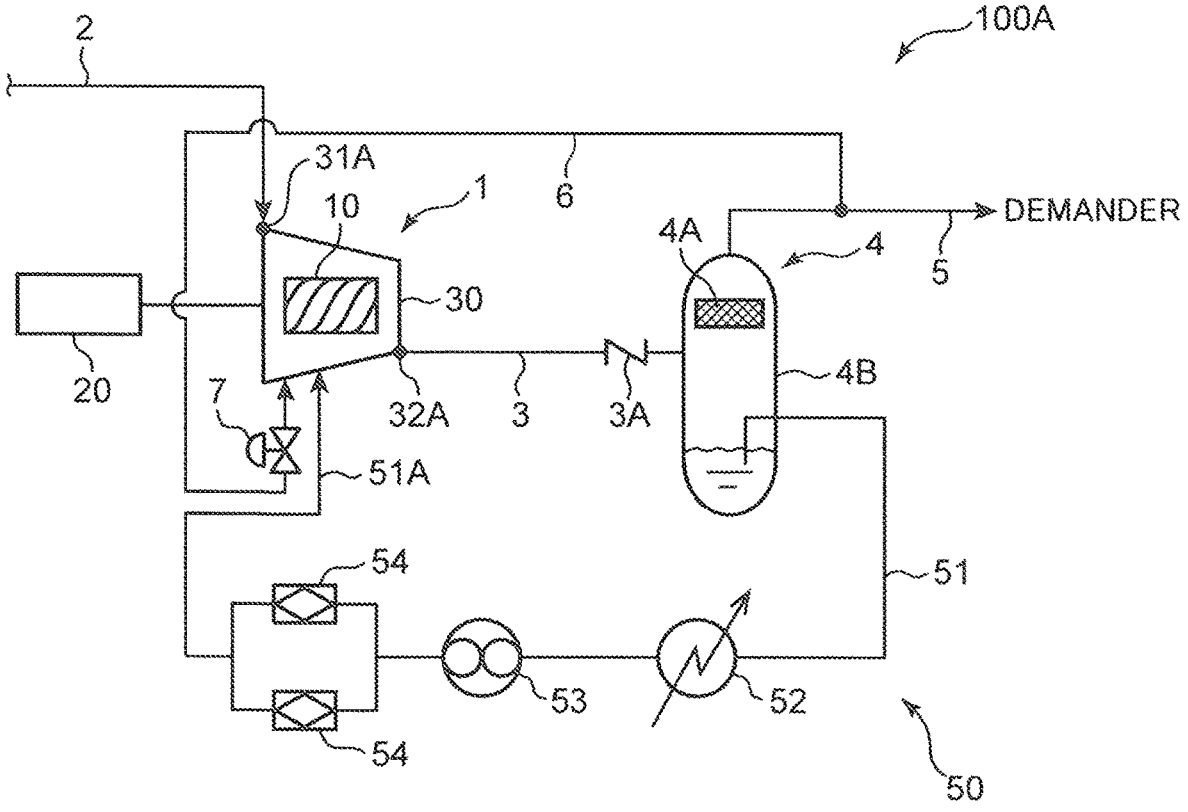
FIG. 1 is a schematic system diagram of a gas compression system to which a screw compressor according to a first embodiment of the present invention is applied.
Figure 2:
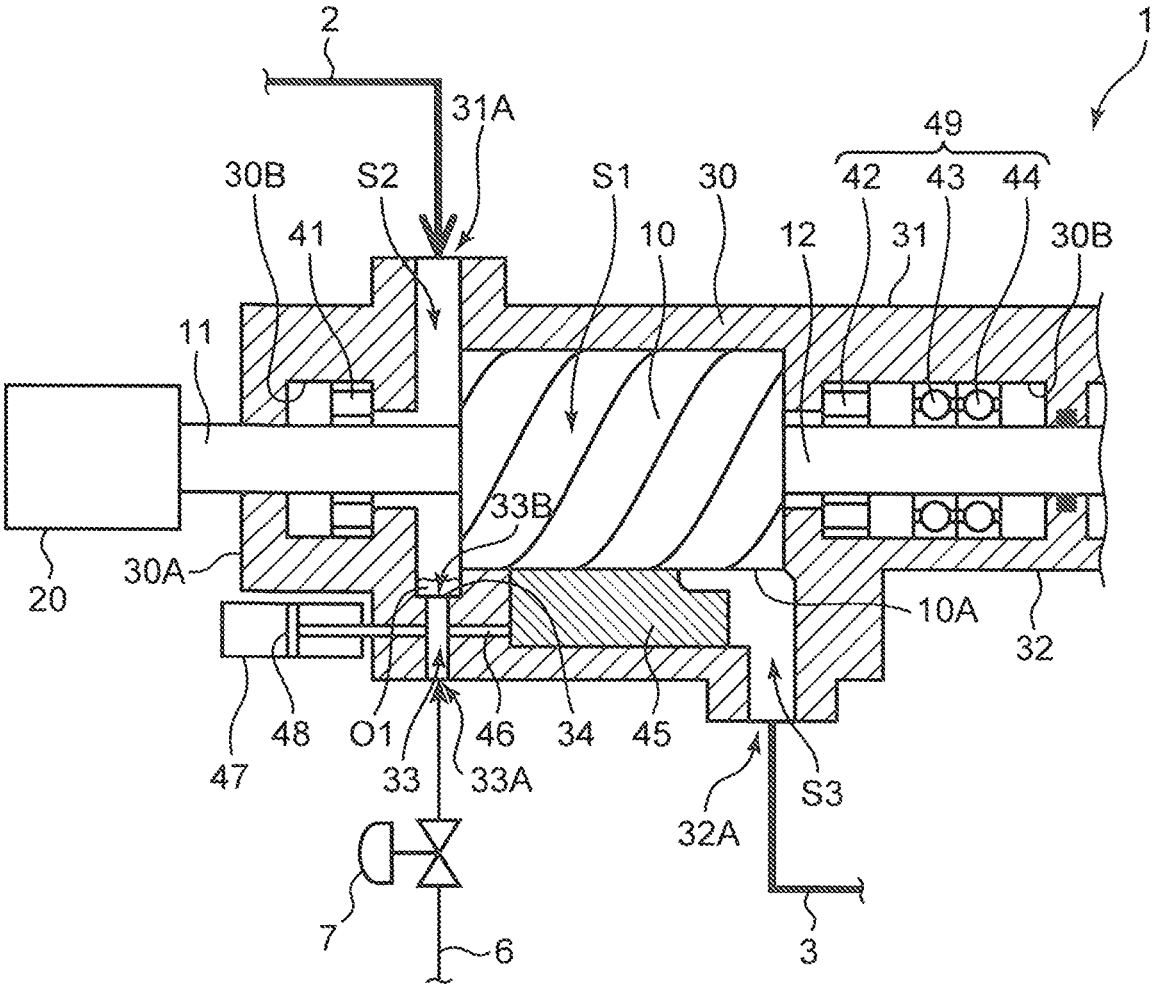
FIG. 2 is a schematic cross-sectional view of the configuration of the screw compressor according to the first embodiment of the present invention.

First, with reference to FIG. 1 and FIG. 2, description is given of the configuration of a screw compressor 1 according to a first embodiment of the present invention and the configuration of a gas compression system 100A to which the screw compressor 1 is applied. FIG. 1 is a schematic system diagram of the gas compression system 100A according to the present embodiment. FIG. 2 is a schematic partial cross-sectional view of the screw compressor 1. In FIG. 1 and FIG. 2, only main constitutional elements of the gas compression system 100A and the screw compressor 1 are shown, and the gas compression system 100A and the screw compressor 1 may have other arbitrary constitutional elements which are not shown in FIG. 1 and FIG. 2.

The gas compression system 100A is, for example, a system where a boil-off gas generated due to vaporization of a portion of an LNG stored in a tank is supplied to a demander after a pressure of the boil-off gas is increased to a predetermined supply pressure. As shown in FIG. 1, the gas compression system 100A mainly includes the screw compressor 1 for increasing a pressure of a boil-off gas to a predetermined supply pressure, a suction path 2 for introducing the boil-off gas into the screw compressor 1, a discharge path 3 through which the boil-off gas discharged from the screw compressor 1 after being compressed flows, an oil collector 4 for separating oil in a compressed gas and a supply path 5 for introducing the compressed gas from which oil is separated to the demander.

The screw compressor 1 has a screw rotor 10 for compressing a boil-off gas due to rotation of the screw rotor 10 about an axis of the screw rotor 10, a casing 30 housing the screw rotor 10 rotatably about an axis of the screw rotor 10 and a motor 20 which is a drive part for generating a drive force for rotating the screw rotor 10 about the axis of the screw rotor 10. As shown in FIG. 1, a suction port 31A for a gas before being compressed and a discharge port 32A for a gas after being compressed are formed on both sides of the casing 30 in an axial direction. The detailed configuration of the screw compressor 1 is described later.

An upstream end of the suction path 2 is connected to an LNG tank not shown in the drawing, and a downstream end of the suction path 2 is connected to the suction port 31A of the casing 30. With such a configuration, a boil-off gas generated in the LNG tank can be introduced into the casing 30 through the suction path 2. In such a configuration, equipment for heating a gas before being compressed (for example, a heat exchanger or the like) is not disposed on the suction path 2. Accordingly, the boil-off gas which flows out from the LNG tank is introduced into the casing 30 while maintaining the boil-off gas in a low temperature state.

An upstream end of the discharge path 3 is connected to the discharge port 32A of the casing 30, and a downstream end of the discharge path 3 is connected to an inlet of the oil collector 4. With such a configuration, a compressed gas discharged from the screw compressor 1 can be introduced into the oil collector 4 through the discharge path 3. A check valve 3A which prevents a revers flow of a compressed gas may be provided to the discharge path 3. However, the present invention is not limited to such a configuration.

The oil collector 4 is provided for separating oil in a compressed gas discharged from the screw compressor 1 and for collecting the oil. The oil collector 4 has a container 4B in which oil separated from a compressed gas is stored and a separation element 4A which is a filter disposed in the container 4B and made of fine fibers or the like.

A compressed gas discharged from the screw compressor 1 flows into the container 4B through the discharge path 3, and passes through the separation element 4A. Accordingly, oil in the compressed gas is separated. The gas which passes through the separation element 4A flows out to the outside of the container 4B. On the other hand, the oil captured by the separation element 4A stays on a bottom of the container 4B.

An upstream end of the supply path 5 is connected to an outlet of the oil collector 4, and a downstream end of the supply path 5 is connected to a demander. Accordingly, it is possible to supply a compressed gas which flows out from the oil collector 4 (the compressed gas from which oil is separated) to the demander through the supply path 5.

Next, the configuration of the screw compressor 1 is described in detail with reference to FIG. 2. As shown in FIG. 2, the screw compressor 1 mainly includes the screw rotor 10 having an axially extending shape, a suction side shaft portion 11 connected to one end surface of the screw rotor 10 in an axial direction (a suction side end surface), a discharge side shaft portion 12 connected to the other end surface of the screw rotor 10 in the axial direction (a discharge side end surface), a suction side bearing 41 fitted on the suction side shaft portion 11, a discharge side bearing 49 fitted on the discharge side shaft portion 12 and the casing 30 which houses these constitutional elements.

The screw rotor 10 has a pair of male and female rotors. The male rotor and the female rotor each have an axially extending shape, and a spiral teeth portions on an outer peripheral surface. The male rotor and the female rotor are housed in the casing 30 such that the teeth portions mesh with each other. The screw rotor 10 compresses a gas sucked from one end side in an axial direction (a left end side in FIG. 2) due to the rotation of the screw rotor 10 about an axis of the screw rotor 10, and discharges the compressed gas from the other end side in the axial direction (a right end side in FIG. 2).

The suction side shaft portion 11 is coaxially rotatably connected with the screw rotor 10, and one end of the suction side shaft portion 11 protrudes toward the outside from an outer side surface 30A of the casing 30. The motor 20 is mounted on a protruding end of the suction side shaft portion 11. The screw rotor 10 can be rotated about the axis of the screw rotor 10 by driving the motor 20. The present invention is not limited to the case where the suction side shaft portion 11 protrudes toward the outside of the casing 30, and the motor 20 may be housed in the casing 30.

The suction side bearing 41 is a radial bearing (for example, a roller bearing) and is mounted between an outer peripheral surface of the suction side shaft portion 11 and an inner surface 30B of the casing 30. The suction side shaft portion 11 is rotatably supported about an axis of the suction side shaft portion 11 by the suction side bearing 41.

The discharge side shaft portion 12 is coaxially rotatably connected to the screw rotor 10 in the same manner as the suction side shaft portion 11. In the present embodiment, the discharge side bearing 49 includes first to third bearing elements 42, 43, and 44. The first to third bearing elements 42, 43 and 44 are radial bearings (for example, roller bearings or ball bearings) which are fitted on the discharge side shaft portion 12, and are mounted between an outer peripheral surface of the discharge side shaft portion 12 and the inner surface 30B of the casing 30. With such a configuration, the discharge side shaft portion 12 is rotatably supported about the axis of the discharge side shaft portion 12. The number of the bearing elements which form the discharge side bearing 49 is not particularly limited.

The casing 30 is provided with a suction port 31A and a discharge port 32A. The suction port 31A opens toward an upper surface 31 side, and the discharge port 32A opens toward a lower surface 32 side. The positions of the suction port 31A and the discharge port 32A are not limited to the positions shown in FIG. 2.

An inner space of the casing 30 is defined by the inner surface 30B. The inner space includes a rotor housing space S1 in which the screw rotor 10 is housed, a suction side space S2 through which a gas flowing into the casing 30 from the suction port 31A and not yet sucked by the screw rotor 10 flows and a discharge side space S3 into which a compressed gas discharged from the screw rotor 10 flows.

The suction side space S2 is provided at one side of the screw rotor 10 in the axial direction of the casing 30, and introduces a gas which flows through the suction port 31A into the screw rotor 10. The discharge side space S3 is provided below the screw rotor 10, and introduces a compressed gas discharged from the screw rotor 10 to the discharge port 32A. The position of the discharge side space S3 is not limited to an area below the screw rotor 10. As shown in FIG. 2, the inner surface 30B of the casing 30 includes a bottom surface 34 which is positioned below a lower portion 10A of the screw rotor 10 (lower surface 32 side). The bottom surface 34 is a surface which faces the suction side space S2.

The screw compressor 1 includes a slide valve 45 which regulates a compression capacity of the screw rotor 10. As shown in FIG. 2, a distal end of the piston rod 46 is connected to the slide valve 45. A piston 48 moves horizontally with the supply of working oil into a hydraulic cylinder 47, and makes the slide valve 45 slide in the axial direction of the screw rotor 10 with the supply of working oil into the hydraulic cylinder 47. Accordingly, a pressure of a gas discharged from the screw rotor 10 to the discharge side space S3 can be regulated. The slide valve 45 is not an indispensable constitutional element in the screw compressor of the present invention, and may be omitted.

The screw compressor 1 is an oil-cooled screw compressor which eliminates heat generated by compression in the casing 30 by oil, and includes an oil supply unit 50 which returns oil collected by the oil collector 4 to the casing 30.

As shown in FIG. 1, the oil supply unit 50 has an oil supply pipe 51, an oil cooler 52, an oil pump 53 and an oil filter 54. The oil cooler 52, the oil pump 53 and the oil filter 54 are disposed on the oil supply pipe 51. The oil supply pipe 51 is a pipe for returning oil collected by the oil collector 4 into the casing 30. One end of the oil supply pipe 51 is positioned in the vicinity of a bottom portion of the container 4B for sucking oil reserved in the container 4B into the pipe. On the other hand, the other end 51A of the oil supply pipe 51 is connected to the casing 30 so as to enable the supply of oil into the space in which the screw rotor 10, the bearings 41, 49 or the slide valve 45 are housed.

The oil cooler 52 cools oil which flows in the oil supply pipe 51. The oil pump 53 is provided for pumping up oil reserved in the container 4B to the oil supply pipe 51, and disposed downstream of the oil cooler 52. The oil filters 54 are provided for removing a foreign substance contained in oil, and are disposed parallel to each other downstream of the oil pump 53. In the present embodiment, oil carried to the downstream of the casing 30 can be collected by the oil collector 4, the collected oil can be returned to the casing 30 by the oil supply unit 50. That is, oil can be circulated between the casing 30 and the container 4B of the oil collector 4. The oil supply unit 50 may be omitted.

As shown in FIG. 2, there is a case that oil O1 stays in the suction side space S2 of the casing 30. Specifically, oil O1 which is present on the bottom surface 34 positioned on a side lower than the lower portion 10A of the screw rotor 10 is not sucked into the screw rotor 10 and hence, oil O1 stays in the suction side space S2.

When a boil-off gas of an ultra-low temperature flows into the inside of the suction side space S2 from the suction port 31A, oil O1 staying on the bottom surface 34 is frozen. To cope with such a drawback, the screw compressor 1 according to the present embodiment is configured to introduce a heating fluid to the suction side space S2 of the casing 30. Accordingly, such freezing of oil can be prevented by heating the oil using the heating fluid.

A heating fluid passage 33 (hereinafter simply referred to as "passage 33") for introducing a heating fluid into the suction side space S2 so as to heat oil O1 staying in the suction side space S2 is formed in the casing 30. The passage 33 is formed of a hole which penetrates a lower wall portion of the casing positioned on a lower side of the suction side space S2 in a thickness direction.

As shown in FIG. 2, the heating fluid passage 33 has an inlet 33A which opens toward the outside of the casing 30 and an outlet 33B which opens toward the suction side space S2. The inlet 33A is formed on the lower surface 32 of the casing 30, and the outlet 33B is formed on the bottom surface 34 of the casing 30. Accordingly, the passage 33 opens toward the suction side space S2 at the bottom surface 34, that is, on a side lower than the lower portion 10A of the screw rotor 10.

As shown in FIG. 1 and FIG. 2, the screw compressor 1 includes a gas introducing path 6 (heating fluid introducing path) through which a compressed gas discharged from the screw compressor 1 is introduced into the passage 33 as a heating fluid and a valve 7 provided to the gas introducing path 6. One end of the gas introducing path 6 is connected to the supply path 5 (FIG. 1), and the other end of the gas introducing path 6 is connected to the inlet 33A of the passage 33 (FIG. 2). An open/close control of the valve 7 is performed by a control part not shown in the drawing. The valve 7 controls the introduction of a heating fluid from the gas introducing path 6 to the passage 33 by switching flowing state of gas in the gas introducing path 6 between the state in which gas flow is allowed and the state in which gas flow is blocked. The valve 7 may be a valve which is manually switched between an open state and a closed state. Although the valve 7 may be an ON/OFF valve, the valve 7 is not limited to such a valve and may be a flow rate regulating valve, for example.

With the above-mentioned configuration, by opening the valve 7, a compressed gas from which oil is separated and which flows in the supply path 5 can be introduced into the heating fluid passage 33 through the gas introducing path 6 as a heating fluid and, then, the compressed gas can be introduced into the suction side space S2 from the passage 33. With such an operation, oil O1 staying on the bottom surface 34 of the suction side space S2 is heated so that freezing of oil O1 can be prevented, and frozen oil O1 can be also melted. The present embodiment may adopt a configuration where the valve 7 is omitted and a fixed amount of a compressed gas is constantly introduced into the passage 33 from the supply path 5.

According to the screw compressor 1 of the first embodiment, the following technical features and the following functions and effects are obtained.

The screw compressor 1 includes the screw rotor 10 which compresses a gas due to rotation of the screw rotor 10 about an axis of the screw rotor 10 and the casing 30 which houses the screw rotor 10 rotatably and has the suction port 31A for gas. The casing 30 has the suction side space S2 through which a gas flowing into the casing 30 from the suction port 31A and not yet sucked by the screw rotor 10 flows. The casing 30 is provided with the heating fluid passage 33 through which a heating fluid is introduced into the suction side space S2 so as to heat oil O1 staying in the suction side space S2.

According to the screw compressor 1, by introducing a heating fluid into the suction side space S2 of the casing 30 through the heating fluid passage 33, oil O1 staying in the suction side space S2 can be heated. With such heating, even when a gas whose temperature is lower than a freezing point of oil O1 is introduced into the suction side space S2 from the suction port 31A, freezing of oil O1 can be prevented by heating oil O1 using the heating fluid. Further, when oil O1 is already frozen, the frozen oil O1 can be melted. According to the screw compressor 1, in preventing freezing of oil O1 in the casing 30, it is unnecessary to provide gas heating equipment or the like to the suction path 2 and hence, it is also possible to prevent a facility from becoming complicated. According to the screw compressor 1, it is possible to prevent freezing of oil O1 in the casing 30 even when the screw compressor 1 is used for compressing a low temperature gas, while preventing a facility from becoming complicated in a path for introducing a gas into the compressor.

In the screw compressor 1, the heating fluid passage 33 opens toward the suction side space S2 on a side lower than the lower portion 10A of the screw rotor 10. With such a configuration, a heating fluid can be introduced into a region on a side lower than the lower portion 10A of the screw rotor 10 in the suction side space S2. On the other hand, oil O1 which is present in the suction side space S2 stays in the suction side space S2 without being sucked by the screw rotor 10 when oil O1 is present on a side lower than the lower portion 10A of the screw rotor 10. Accordingly, due to the above-mentioned configuration, a heating fluid can be directly supplied to oil O1 staying in the suction side space S2 and hence, freezing of oil O1 can be prevented with more certainty.

The screw compressor 1 includes the gas introducing path 6 through which a compressed gas discharged from the screw compressor 1 is introduced into the heating fluid passage 33 as a heating fluid and the valve 7 which is provided to the gas introducing path 6 and controls the introduction of the heating fluid from the gas introducing path 6 to the heating fluid passage 33. In this manner, by using a gas compressed by the screw compressor 1 as a heating fluid, oil O1 in the casing 30 can be effectively heated using heat generated by compression of a gas. Further, the introduction of the heating fluid into the heating fluid passage 33 can be easily controlled by switching the valve 7 between an open state and a closed state and by regulating the degree of opening of the valve 7.

Second Embodiment

Next, a screw compressor 1A according to a second embodiment of the present invention is described with reference to FIG. 3. The screw compressor 1A according to the second embodiment basically has substantially the same configuration as the screw compressor 1 according to the first embodiment, and acquires substantially the same advantageous effects as the screw compressor 1 according to the first embodiment. However, the screw compressor 1A of the second embodiment differs from the screw compressor 1 of the first embodiment in that oil is used as a heating fluid. Hereinafter, the second embodiment is described only in respects different from the first embodiment.

Figure 3:
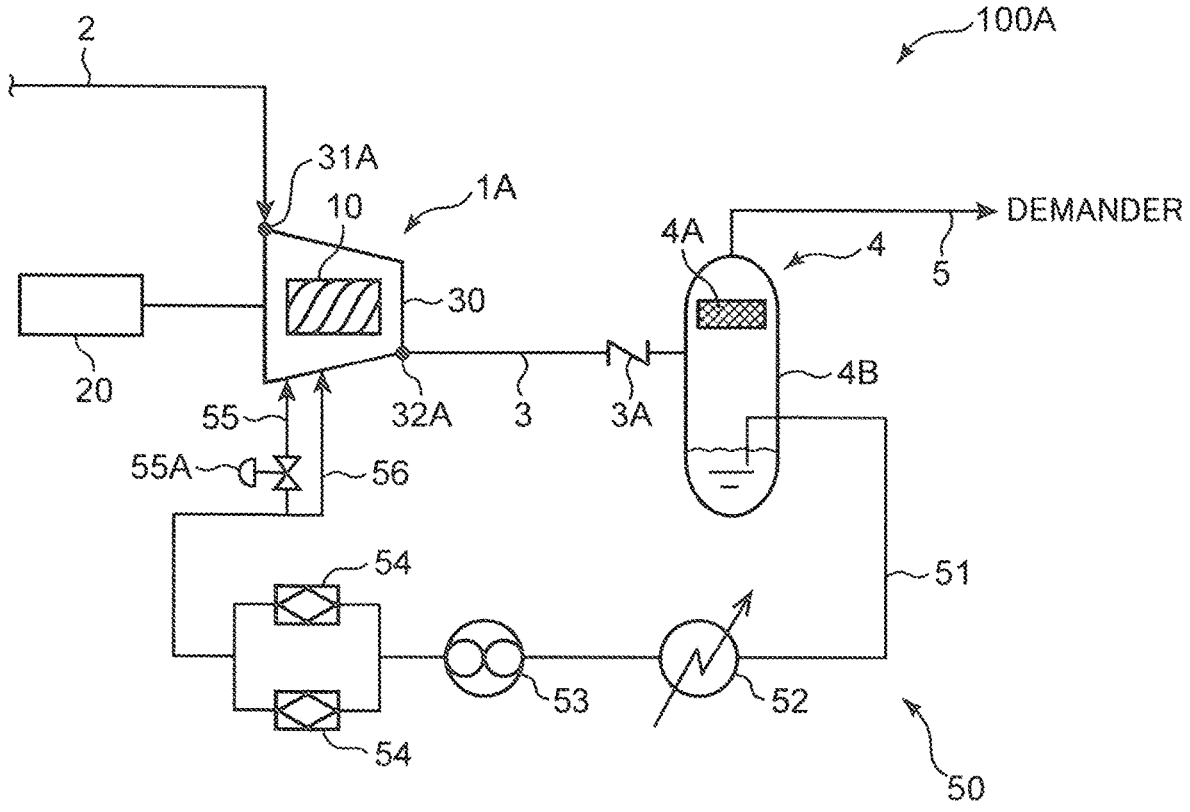
FIG. 3 is a schematic view for describing the configuration of a screw compressor according to a second embodiment of the present invention.

As shown in FIG. 3, in an oil supply unit 50 of the second embodiment, the other end of an oil supply pipe 51 (an end portion of the oil supply pipe 51 on a side opposite to one end positioned within an oil collector 4) is branched into a main path 56 and an oil introducing path 55 (heating fluid introducing path).

The main path 56 is connected to a casing 30 such that oil collected by the oil collector 4 can be supplied to a space in which a screw rotor 10, bearings, a slide valve and the like are housed. On the other hand, the oil introducing path 55 is connected to an inlet 33A (FIG. 2) of a heating fluid passage 33 in the same manner as the gas introducing path 6 of the first embodiment. In the oil introducing path 55, a valve 55A for switching flowing state of oil in the oil introducing path 55 between the state in which oil flow is allowed and the state in which oil flow is blocked is provided.

In the screw compressor 1A according to the second embodiment, by opening the valve 55A, a part of oil to be supplied to the space in which the screw rotor 10 is housed from a container 4B of the oil collector 4 can be introduced into the heating fluid passage 33 (FIG. 2) through the oil introducing path 55 as a heating fluid. In this manner, a part of the oil used for lubrication of the screw rotor 10 and the like can be used as a heating fluid. Accordingly, it is unnecessary to additionally provide a heating fluid supply mechanism other than the oil supply unit 50 and hence, the device can be simplified. However, the oil introducing path 55 of the second embodiment may be used together with the gas introducing path 6 of the first embodiment in the same screw compressor.

Third Embodiment

Next, a screw compressor 1B according to a third embodiment of the present invention is described with reference to FIG. 4 and FIG. 5. The screw compressor 1B according to the third embodiment basically has substantially the same configuration as the screw compressor 1 according to the first embodiment, and acquires substantially the same advantageous effects as the screw compressor 1 of the first embodiment. However, the screw compressor 1B of the third embodiment differs from the screw compressor 1 of the first embodiment in that a timing of introducing a heating fluid is controlled based on a temperature of a sucked gas. Hereinafter, the third embodiment is described only in respects different from the first embodiment.

Figure 4:
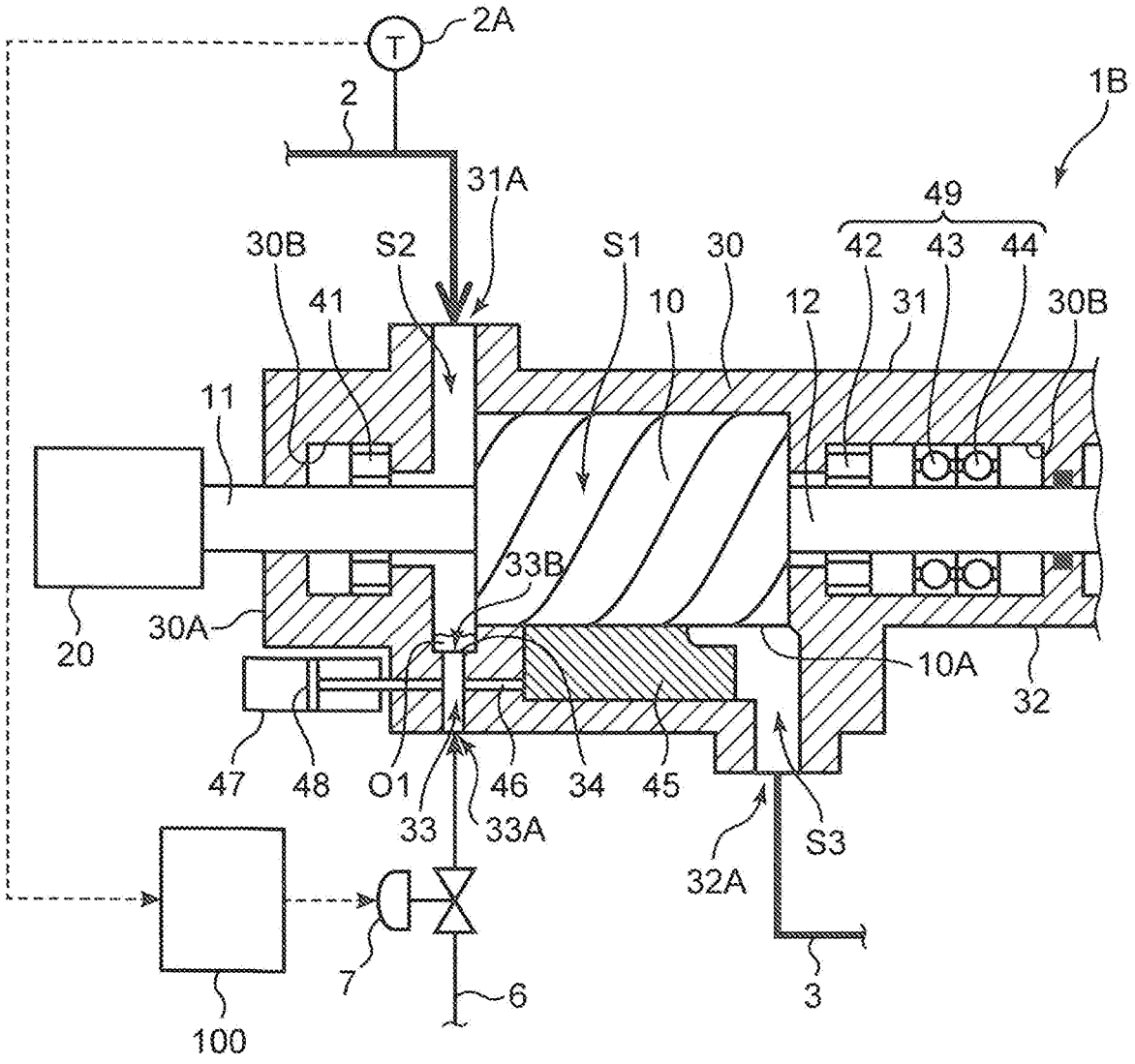
FIG. 4 is a schematic view for describing the configuration of a screw compressor according to a third embodiment of the present invention.

As shown in FIG. 4, a temperature sensor 2A which detects a temperature of a gas flowing through a suction path 2 is provided to the suction path 2. Due to the provision of the temperature sensor 2A, a temperature of a gas flowing from a suction port 31A into a casing 30 (a temperature of a sucked gas) can be detected.

The screw compressor 1B includes a control part 100 which receives a detection result from the temperature sensor 2A, and controls opening/closing of a valve 7 based on the detection result. In the third embodiment, a timing of introducing a heating fluid into a suction side space S2 is controlled based on a temperature of a sucked gas in accordance with the following steps.

Figure 5:
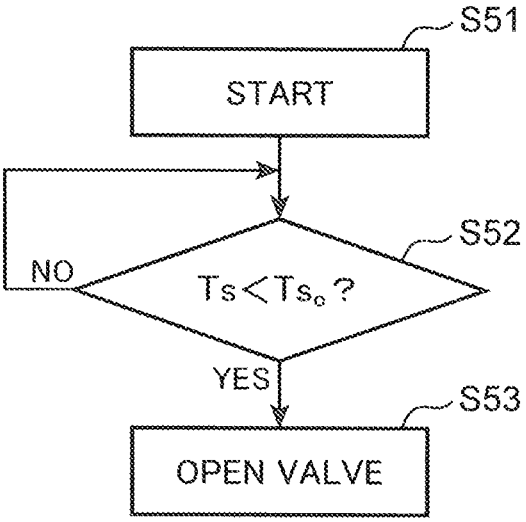
FIG. 5 is a flowchart for describing timing of introducing a heating fluid in the screw compressor according to the third embodiment of the present invention.

As shown in a flowchart in FIG. 5, first, an operation of the screw compressor 1B is started (step S51). At the time of starting the operation of the screw compressor 1B, the valve 7 is in a closed state. Then, the measurement of a temperature of a sucked gas by the temperature sensor 2A is started after starting the operation of the compressor. The control part 100 determines whether or not an actually measured value Ts of a temperature of a sucked gas is lower than a reference temperature $Ts_0$ which is preliminarily set with respect to a sucked gas (step S52). A freezing point of oil can be used as the reference temperature $Ts_0$, for example. However, the reference temperature $Ts_0$ is not particularly limited.

When the actually measured value Ts of a temperature of a sucked gas is lower than the reference temperature $Ts_0$ (YES in step S52), the valve 7 is opened in accordance with an instruction from the control part 100 (step S53). With such an operation, a compressed gas is introduced into the heating fluid passage 33 from the gas introducing path 6 as a heating fluid, and the heating fluid is introduced into the suction side space S2 of the casing 30.

On the other hand, when the actually measured value Ts of the temperature of the sucked gas is equal to or more than the reference temperature $Ts_0$ (NO in step S52), the control part 100 does not open the valve 7, and a heating fluid is not introduced into the suction side space S2 of the casing 30. In this case, the determination step in step S52 is repeated.

In the screw compressor 1B according to the second embodiment, a heating fluid can be introduced so as to heat oil at a proper timing at which a temperature of a sucked gas is low so that freezing of oil is likely to occur. Accordingly, freezing of oil in the suction side space S2 of the casing 30 can be prevented with more certainty. In the present embodiment, the description has been given of the case where a compressed gas is used as a heating fluid. However, the control of the timing of introducing a heating fluid described in the present embodiment is also applicable to the case where oil is used as a heating fluid (second embodiment) in the same manner.

Fourth Embodiment

Next, a screw compressor 1C according to a fourth embodiment of the present invention is described with reference to FIG. 6 and FIG. 7. The screw compressor 1C according to the fourth embodiment basically has substantially the same configuration as the screw compressor 1 according to the first embodiment, and acquires substantially the same advantageous effects as the screw compressor 1 of the first embodiment. However, the screw compressor 1C according to the fourth embodiment differs from the screw compressor 1 according to the first embodiment in that a timing of introducing a heating fluid is controlled based on a position of a slide valve 45. Hereinafter, the fourth embodiment is described only in respects different from the first embodiment.

Figure 6:
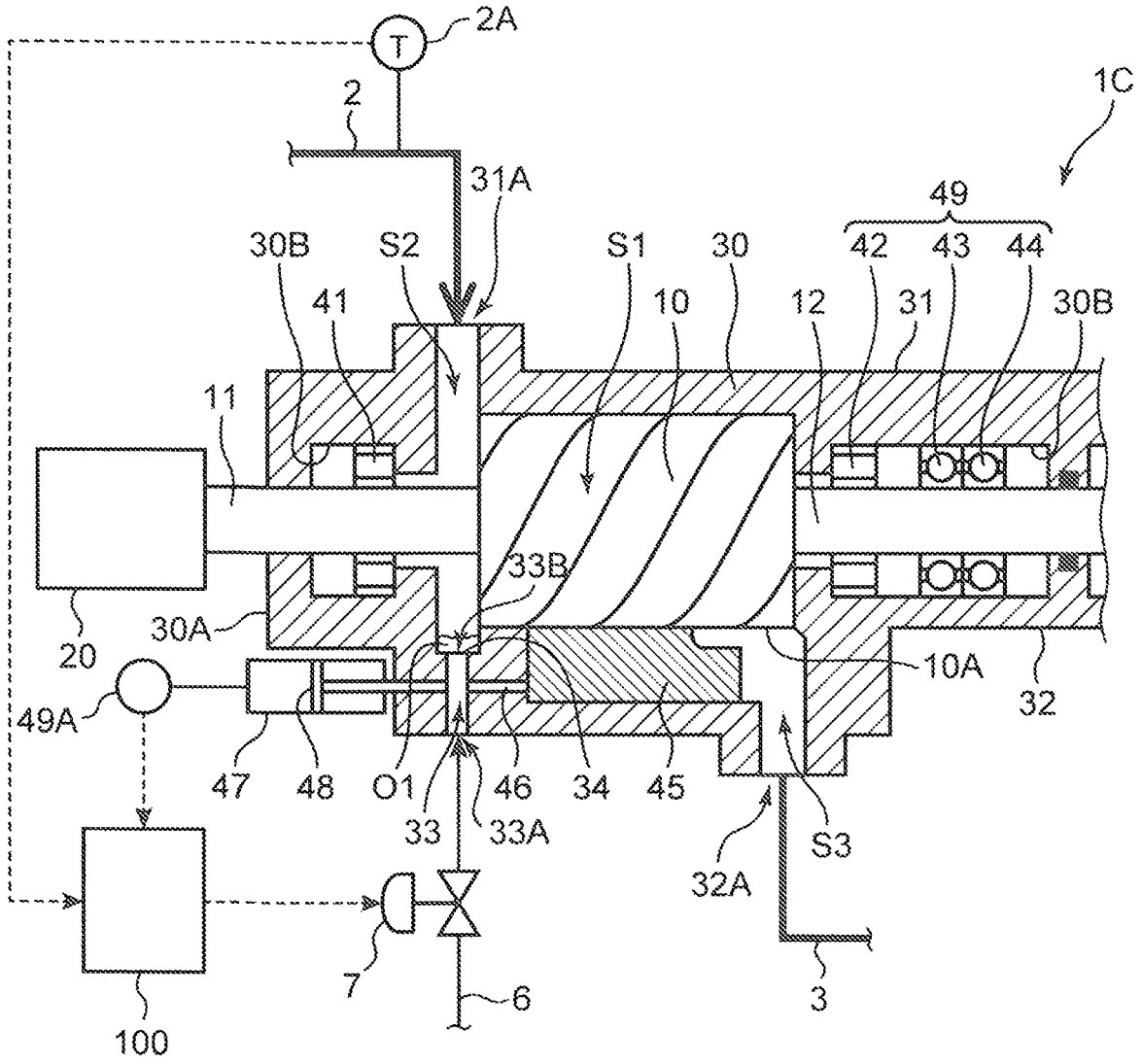
FIG. 6 is a schematic view for describing the configuration of a screw compressor according to a fourth embodiment of the present invention.

As shown in FIG. 6, the screw compressor 1C according to the fourth embodiment includes a position detecting part 49A which is a sensor for detecting a position of the slide valve 45 in an axial direction of a screw rotor 10 (a sliding direction of the slide valve 45). A detection result from a position detecting part 49A is transmitted to a control part 100. In the fourth embodiment, a timing of introducing a heating fluid is controlled based on the position of the slide valve 45 in accordance with following steps.

Figure 7:
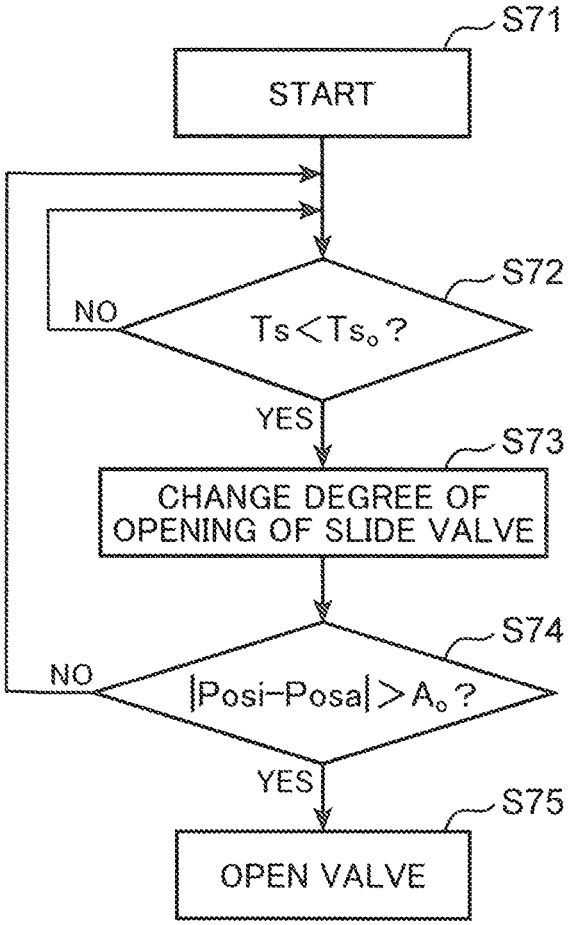
FIG. 7 is a flowchart for describing timing of introducing a heating fluid in the screw compressor according to the fourth embodiment of the present invention.

As shown in a flowchart of FIG. 7, first, an operation of the screw compressor 1C is started (step S71). At the time of starting the operation of the screw compressor 1C, a valve 7 (FIG. 6) is in a closed state. Then, the measurement of a temperature of a sucked gas is started by a temperature sensor 2A after starting an operation of the compressor. A control part 100 determines whether or not an actually measured value Ts of a temperature of a sucked gas is lower than a reference temperature $Ts_0$ (step S72). When the actually measured value Ts of the temperature of the sucked gas is lower than the reference temperature $Ts_0$ (YES in step S72), processing proceeds to next step S73. On the other hand, when the actually measured value Ts is equal to or more than the reference temperature $Ts_0$ (NO in step S72), the determination in step S72 is repeated.

In step S73, the degree of opening of the slide valve 45 is changed by sliding the slide valve 45 in the axial direction of the screw rotor 10. In the screw compressor 1C, a discharge pressure of a gas from a screw rotor 10 is regulated by changing the position of the slide valve 45 in an axial direction of the rotor. In next step S74, an instructed position $P_{osi}$ of the slide valve 45 after being slid which is inputted in step S73 and an actual position $P_{osa}$ of the slide valve 45 after being slid which is detected by the position detecting part 49A are compared with each other. Then, the control part 100 determines whether or not a difference (absolute value) between the instructed position $P_{osi}$ and the actual position $P_{osa}$ exceeds a preset reference value $A_0$.

When the difference between the instructed position $P_{osi}$ and the actual position $P_{osa}$ exceeds the reference value $A_0$ (YES in step S74), the control part 100 opens the valve 7 (step S75). With such an operation, a compressed gas is introduced into a heating fluid passage 33 from a gas introducing path 6 as a heating fluid, and the heating fluid is introduced into a suction side space S2 of a casing 30. On the other hand, when the difference between the instructed position $P_{osi}$ and the actual position $P_{osa}$ is equal to or less than the preset reference value $A_0$ (NO in step S74), the control part 100 does not open the valve 7, and a heating fluid is not introduced into the suction side space S2 of the casing 30. In this case, processing returns to the determination step in step S72.

In the case where the degree of opening of the slide valve 45 is changed, when the difference between an actual position of the slide valve 45 after being changed (a detected position which is detected by the position detecting part 49A) and an instructed position of the slide valve 45 (set position) is large, it is considered that a normal operation of the slide valve 45 is obstructed by freezing of oil in the casing 30. According to the screw compressor 1C of the fourth embodiment, a heating fluid can be introduced into the casing 30 at a proper timing where it is considered that the difference between both positions is large so that oil is frozen in the casing 30. The step S72 in which the actually measured temperature of a sucked gas is compared with the reference temperature may be omitted.

In the present embodiment, the description has been given of the case where a compressed gas is used as a heating fluid. However, the control of the timing of introducing a heating fluid described in the present embodiment is also applicable to the case where oil is used as a heating fluid (second embodiment) in the same manner. Further, the control of the timing based on the position of the slide valve 45 described in the present embodiment may be combined with the control of the timing based on a temperature of a sucked gas described in the third embodiment.

Fifth Embodiment

Next, a screw compressor 1D according to a fifth embodiment of the present invention is described with reference to FIG. 8 and FIG. 9. The screw compressor 1D according to the fifth embodiment basically has substantially the same configuration as the screw compressor 1 according to the first embodiment, and acquires substantially the same advantageous effects as the screw compressor 1 of the first embodiment. However, the screw compressor 1D according to the fifth embodiment differs from the screw compressor 1 according to the first embodiment in that a timing of introducing a heating fluid is controlled based on a height of a liquid surface of oil in an oil collector 4. Hereinafter, the fifth embodiment is described only in respects different from the first embodiment.

Figure 8:
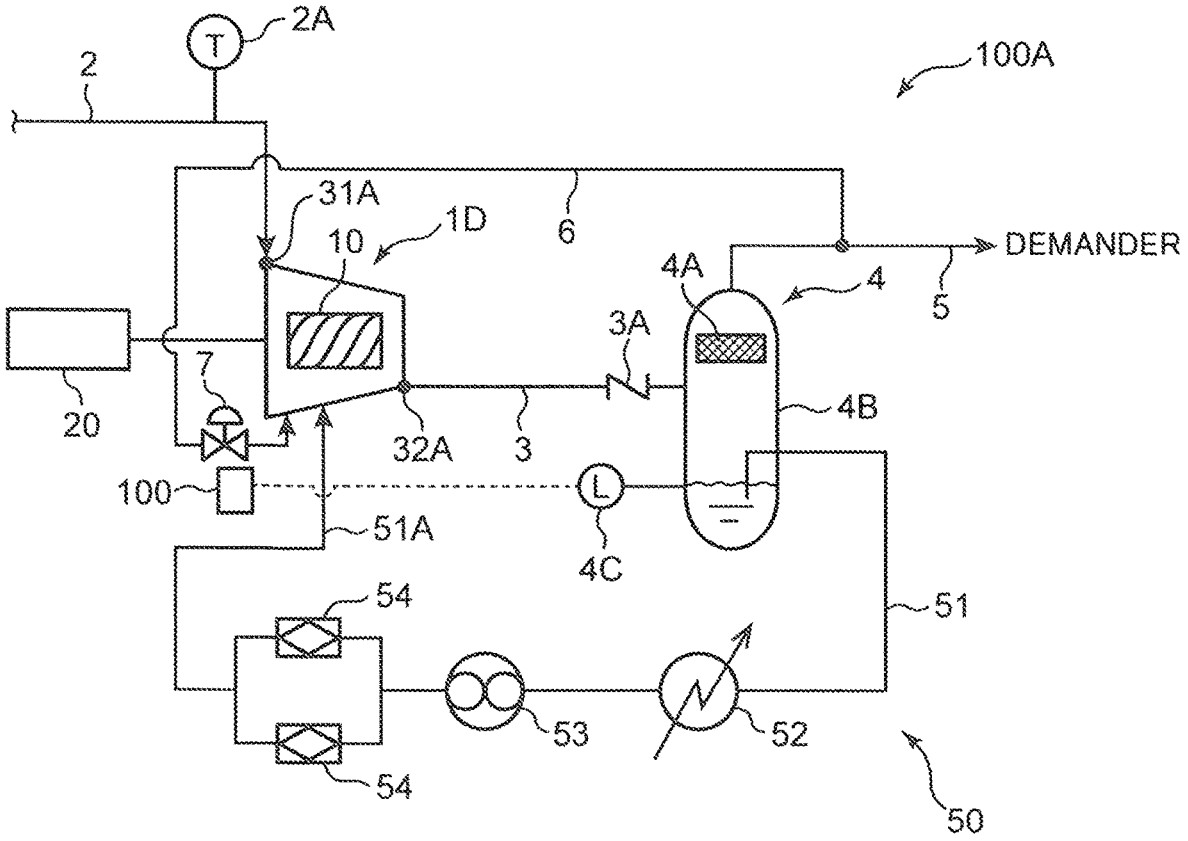
FIG. 8 is a schematic view for describing the configuration of a screw compressor according to a fifth embodiment of the present invention.

As shown in FIG. 8, a container 4B of the oil collector 4 is provided with a level sensor 4C. The level sensor 4C is a sensor for detecting whether or not a height of a liquid surface of oil in the container 4B is lower than a preset reference height, and the level sensor 4C transmits a detection result to a control part 100 of the screw compressor 1D. In the fifth embodiment, a timing of introducing a heating fluid is controlled based on a height of a liquid surface of oil in the container 4B in accordance with following steps.

Figure 9:
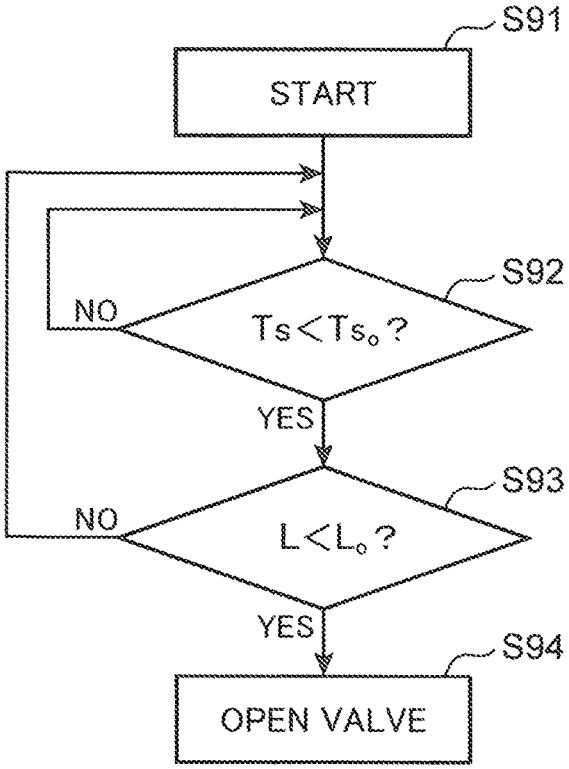
FIG. 9 is a flowchart for describing timing of introducing a heating fluid in the screw compressor according to the fifth embodiment of the present invention.

As shown in a flowchart of FIG. 9, first, an operation of the screw compressor 1D is started (step S91). At the time of starting the operation of the screw compressor 1D, a valve 7 is in a closed state. Then, the measurement of a temperature of a sucked gas is started by a temperature sensor 2A after starting the operation of the screw compressor 1D. The control part 100 determines whether or not an actually measured value Ts of a temperature of a sucked gas is lower than a reference temperature $Ts_0$ (step S92). When the actually measured value Ts of the temperature of the sucked gas is lower than the reference temperature $Ts_0$ (YES in step S92), processing proceeds to next step S93. On the other hand, when the actually measured value Ts is equal to or more than the reference temperature $Ts_0$ (NO in step S92), the determination step in step S92 is repeated. The determination step in step S92 may be omitted.

In step S93, the control part 100 determines whether or not a height L of a liquid surface of oil in the container 4B is lower than a preset reference height $L_0$. When the height L of the liquid surface is lower than the reference height $L_0$ (YES in step S93), the control part 100 opens a valve 7 (step S94). With such an operation, a compressed gas is introduced into a heating fluid passage 33 from a gas introducing path 6 as a heating fluid, and the heating fluid is introduced into a suction side space S2 of a casing 30. On the other hand, when the height L of the liquid surface is equal to or more than the reference height $L_0$ (NO in step S93), the control part 100 does not open the valve 7, and a heating fluid is not introduced into the suction side space S2 of the casing 30. In this case, processing returns to the determination step in step S92.

When the height of the liquid surface of oil in the container 4B of the oil collector 4 is low, it is considered that oil is frozen in the casing 30 so that the flow of oil from the casing 30 into the container 4B is obstructed. According to the screw compressor 1D of the fifth embodiment, a heating fluid can be introduced so as to heat oil at a proper timing where a height of a liquid surface of the oil in the container 4B is low so that freezing of the oil in the casing 30 is expected.

In the present embodiment, the description has been given of the case where a compressed gas is used as a heating fluid. However, the control of the timing of introducing a heating fluid described in the present embodiment is also applicable to the case where oil is used as a heating fluid (second embodiment) in the same manner. Further, a control of a timing based on a height of a liquid surface of oil described in the present embodiment may be combined with a control of a timing based on a temperature of a sucked gas described in the third embodiment or a control of a timing based on the position of the slide valve 45 described in the fourth embodiment.

Sixth Embodiment

Next, a screw compressor 1E according to a sixth embodiment of the present invention is described with reference to FIG. 10 and FIG. 11. The screw compressor 1E according to the sixth embodiment basically has substantially the same configuration as the screw compressor 1 according to the first embodiment, and acquires substantially the same advantageous effects as the screw compressor 1 of the first embodiment. However, the screw compressor 1E according to the sixth embodiment differs from the screw compressor 1 according to the first embodiment in that a timing of introducing a heating fluid is controlled based on vibration frequency of a casing 30. Hereinafter, the sixth embodiment is described only in respects different from the first embodiment.

Figure 10:
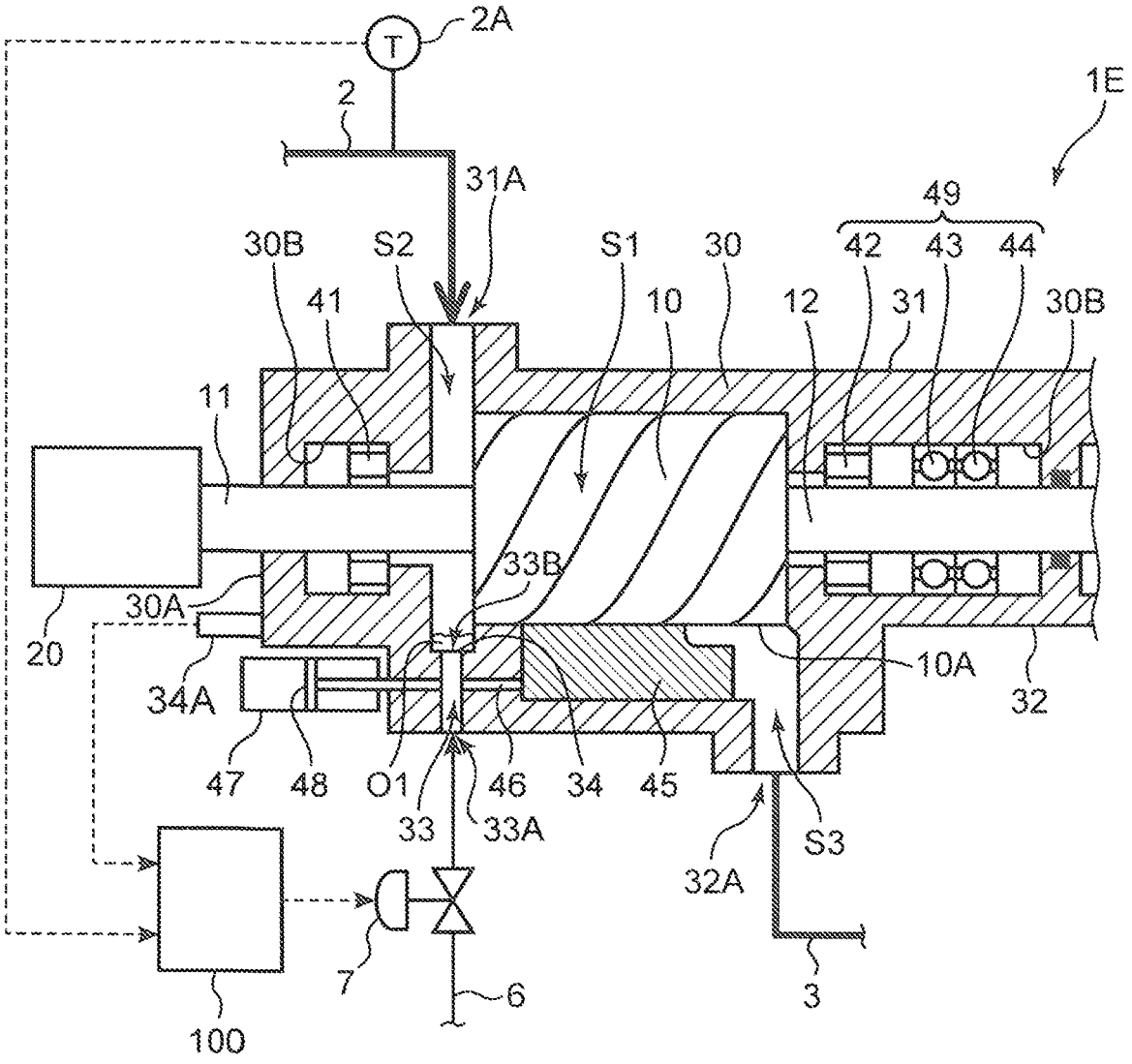
FIG. 10 is a schematic view for describing the configuration of a screw compressor according to a sixth embodiment of the present invention.

As shown in FIG. 10, the screw compressor 1E includes a vibration detecting part 34A which is a sensor for detecting vibration frequency of the casing 30. Although the vibration detecting part 34A is mounted on one outer side surface 30A (an outer side surface closer to a suction side space S2) of the casing 30, the mounting position of the vibration detecting part 34A is not particularly limited. For example, the vibration detecting part 34A may be mounted on an upper surface 31, a lower surface 32, or the other outer side surface of the casing 30. In the sixth embodiment, a timing of introducing a heating fluid is controlled based on vibration frequency of the casing 30 in accordance with following steps.

Figure 11:
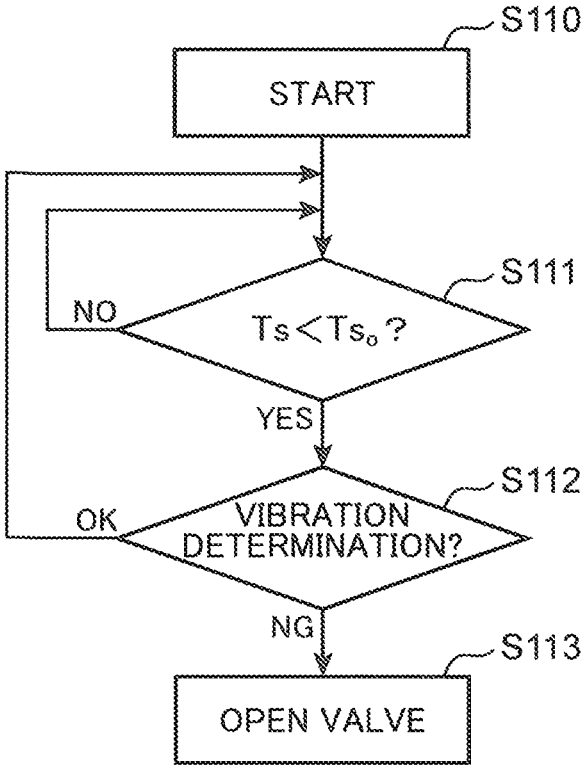
FIG. 11 is a flowchart for describing timing of introducing a heating fluid in the screw compressor according to the sixth embodiment of the present invention.

As shown in a flowchart of FIG. 11, first, an operation of the screw compressor 1E is started (step S110). At the time of starting the operation of the screw compressor 1E, a valve 7 is in a closed state. Then, the measurement of a temperature of a sucked gas is started by a temperature sensor 2A after starting the operation of the screw compressor 1E. A control part 100 determines whether or not an actually measured value Ts of a temperature of a sucked gas is lower than a reference temperature $Ts_0$ (step S111). When the actually measured value Ts of the temperature of the sucked gas is lower than the reference temperature $Ts_0$ (YES in step S111), processing proceeds to next step S112. On the other hand, when the actually measured value Ts is equal to or more than the reference temperature $Ts_0$ (NO in step S111), the determination step in step S111 is repeated. The determination step in step S111 may be omitted.

In step S112, the control part 100 compares vibration frequency of the casing 30 detected by the vibration detecting part 34A with natural vibration frequency of the casing 30, and determines whether or not the difference between the frequencies is equal to or more than a preset reference value. When the difference between the frequencies is equal to or more than the reference value (NG in step S112), the control part 100 opens a valve 7 (step S113). With such an operation, a compressed gas is introduced into a heating fluid passage 33 from a gas introducing path 6 as a heating fluid, and the heating fluid is introduced into a suction side space S2 of the casing 30. On the other hand, when the difference between the frequencies is less than the reference value (OK in step S112), the control part 100 does not open the valve 7, and a heating fluid is not introduced into the suction side space S2 of the casing 30. In this case, processing returns to the determination step in step S111.

When vibration frequency of the casing 30 is largely deviated from natural vibration frequency of the casing 30, it is considered that vibration frequency of the casing 30 is influenced by freezing of oil in the casing 30. According to the screw compressor 1E of the sixth embodiment, a heating fluid can be introduced into the casing 30 so as to heat oil at a proper timing where the deviation of a vibration frequency of the casing 30 from the natural vibration frequency of the casing 30 is large so that a possibility that oil is frozen in the casing 30 is high.

In the present embodiment, the description has been given of the case where a compressed gas is used as a heating fluid. However, the control of the timing of introducing a heating fluid described in the present embodiment is also applicable to the case where oil is used as a heating fluid (second embodiment) in the same manner. Further, a control of a timing based on vibration frequency of the casing 30 described in the present embodiment may be combined with a control of a timing based on a temperature of a sucked gas described in the third embodiment, a control of a timing based on the position of the slide valve 45 described in the fourth embodiment, or a control of a timing based on a height of a liquid surface of oil described in the fifth embodiment.

Seventh Embodiment

Next, a screw compressor 1F according to a seventh embodiment of the present invention is described with reference to FIG. 12. The screw compressor 1F according to the seventh embodiment basically has substantially the same configuration as the screw compressor 1 according to the first embodiment, and acquires substantially the same advantageous effects as the screw compressor 1 of the first embodiment. However, the screw compressor 1F according to the seventh embodiment differs from the screw compressor 1 according to the first embodiment in that a timing of introducing a heating fluid is regulated based on a temperature of a casing 30.

Figure 12:
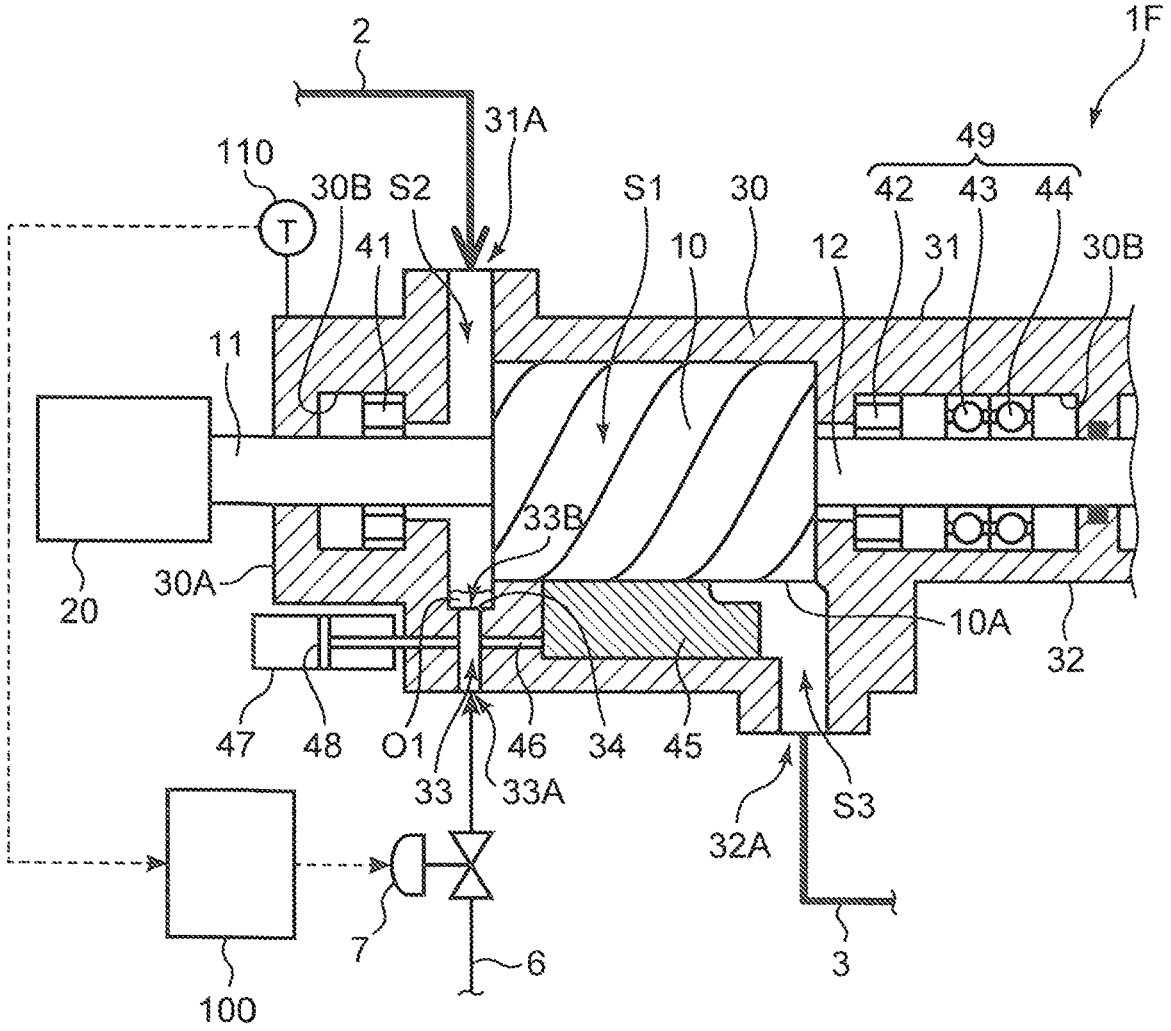
FIG. 12 is a schematic view for describing the configuration of a screw compressor according to a seventh embodiment of the present invention.

As shown in FIG. 12, a temperature sensor 110 which measures a temperature (an outer surface temperature) of the casing 30 is mounted on an outer surface of the casing 30. Although the mounting position of the temperature sensor 110 is not particularly limited, it is preferable that the temperature sensor 110 be mounted in the vicinity of a suction side space S2. The temperature sensor 110 can be mounted on an outer surface of a casing wall which defines the suction side space S2, for example.

In the screw compressor 1F according to the seventh embodiment, a timing of introducing a heating fluid is controlled based on a temperature of the casing detected by the temperature sensor 110. That is, in the seventh embodiment, the timing of introducing a heating fluid is controlled using a temperature of the casing in place of a temperature of a sucked gas in the third embodiment in accordance with the same control flow as the control flow of the third embodiment (FIG. 5). With such a configuration, oil can be heated by introducing a heating fluid at a proper timing at which a temperature of the casing is low so that freezing of oil is likely to occur. A timing control of the seventh embodiment may be combined with timing controls described in the third to sixth embodiments.

OTHER EMBODIMENTS

Finally, other embodiments of the present invention are described.

In the first embodiment, the description has been given of the case where the heating fluid passage 33 is formed of the hole which penetrates the lower wall of the casing 30. However, the present invention is not limited to such a configuration. For example, the heating fluid passage 33 may be formed of a hole which penetrates the side wall of the casing 30. Further, the present invention is not limited to the case where the heating fluid passage 33 opens toward the suction side space S2 lower than the lower portion 10A of the screw rotor 10, and the heating fluid passage 33 may open toward the suction side space S2 above the lower portion 10A of the screw rotor 10.

In the first and second embodiments, the description has been given of only the case where a compressed gas or oil is used as a heating fluid. However, the present invention is not limited to such a case, and equipment for supplying a heating fluid other than the compressed gas and oil may be additionally provided.

In the first embodiment, the description has been given of the single-stage-type screw compressor 1 including only one screw rotor 10. However, the present invention is not limited to such a screw compressor 1. The present invention is also applicable to a multi-stage-type screw compressor having screw rotors in two or more stages.

In the first embodiment, the description has been given of the case where the screw compressor 1 is used for compressing a boil-off gas generated in an LNG tank. However, the application of the compressor is not limited to such a case. For example, the screw compressor of the present invention is also applicable to compression of other types of gasses such as hydrogen or air.

Figure 13:
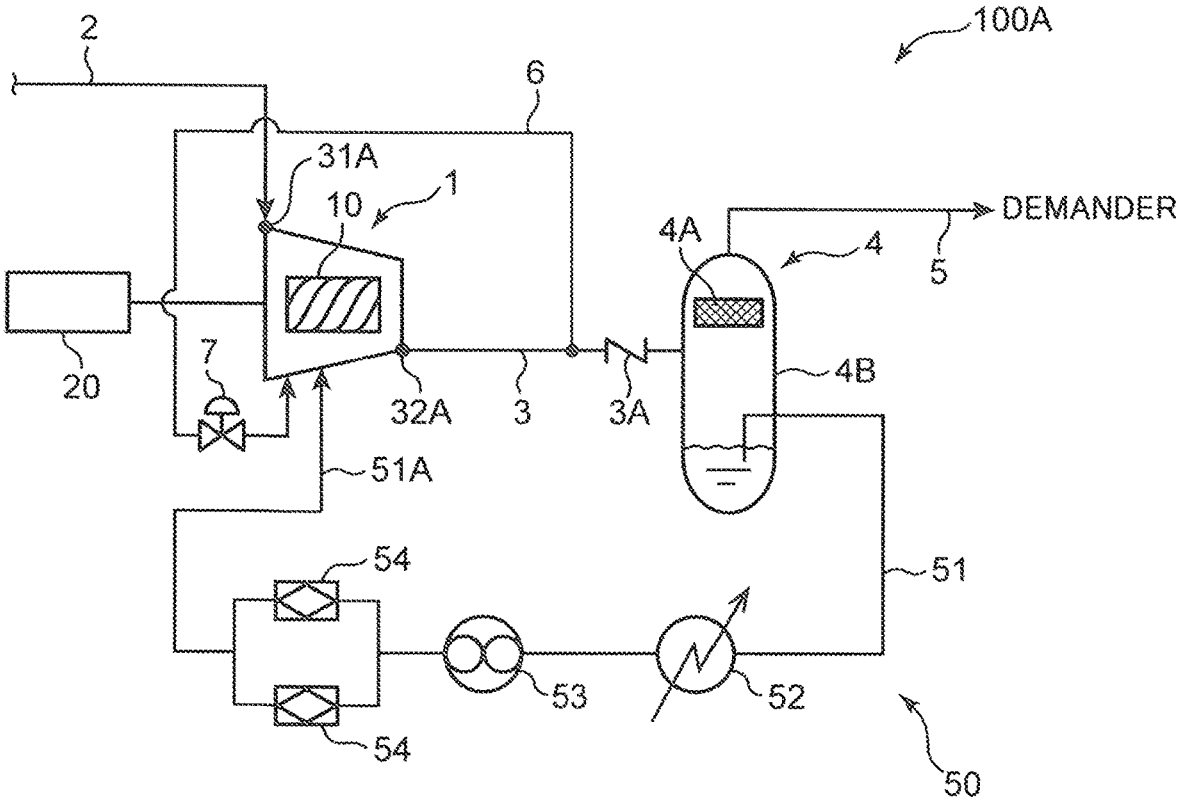
FIG. 13 is a schematic view for describing a screw compressor according to another embodiment of the present invention.

In the first embodiment, the description has been given of the case where the gas introducing path 6 is connected to the supply path 5. However, the present invention is not limited to such a case. As shown in FIG. 13, the gas introducing path 6 may be connected to the discharge path 3, and a compressed gas from which oil is not yet separated may be introduced into the suction side space S2 of the casing 30 as a heating fluid. However, in the case where a compressed gas containing oil is returned to the casing 30 as a heating fluid, there may be the case where it is difficult to design the valve 7 which is suitable for a gas-liquid mixture fluid. Accordingly, it is preferable to return a compressed gas from which oil is separated to the casing 30 as a heating fluid as described in the first embodiment.

To recapitulate the above-mentioned embodiments, the embodiments are described as follows.

A screw compressor according to the above-mentioned embodiments includes a screw rotor configured to compress a gas due to rotation of the screw rotor about an axis of the screw rotor and a casing housing the screw rotor rotatably and provided with a suction port for a gas, the casing being provided with a suction side space through which a gas flowing into the casing from the suction port and not yet sucked by the screw rotor flows. The casing is provided with a heating fluid passage for introducing a heating fluid into the suction side space so as to heat oil staying in the suction side space.

According to the screw compressor, by introducing a heating fluid into the suction side space of the casing through the heating fluid passage, oil staying in the space can be heated. With such a configuration, even when a gas whose temperature is lower than a freezing point of oil is introduced into the suction side space through the suction port, freezing of oil can be prevented by heating the oil using a heating fluid. According to the screw compressor, it is unnecessary to provide a heating equipment to the path for introducing a gas into a compressor in preventing freezing of oil in the casing unlike the prior art and hence, it is also possible to prevent a facility from becoming complicated. As a result, according to the above-mentioned embodiments, it is possible to provide the screw compressor which can prevent freezing of oil in the casing even when the screw compressor is used for compressing a low temperature gas while preventing a facility from becoming complicated in the path for introducing a gas into the compressor.

In the screw compressor, the heating fluid passage may open toward the suction side space on a side lower than a lower portion of the screw rotor.

With such a configuration, a heating fluid can be introduced into a region on a side lower than the lower portion of the screw rotor in the suction side space. On the other hand, with respect to oil which is present in the suction side space, oil which is present on a side lower than the lower portion of the screw rotor stays in the suction side space without being sucked by the screw rotor. Accordingly, with the above-mentioned configuration, a heating fluid can be directly supplied to the oil staying in the suction side space and hence, freezing of the oil can be prevented with more certainty.

The screw compressor may further include a gas introducing path through which a compressed gas discharged from the screw compressor is introduced into the heating fluid passage as the heating fluid.

With such a configuration, by using a gas compressed by the screw compressor as a heating fluid, oil in the casing can be effectively heated using heat generated by compression of a gas.

The screw compressor may further include a valve disposed in the gas introducing path and configured to control introduction of the heating fluid from the gas introducing path to the heating fluid passage.

With such a configuration, the introduction of a heating fluid (compressed gas) into the heating fluid passage can be easily controlled by switching the valve between an open state and a closed state and by regulating a degree of opening of the valve.

The screw compressor may further include an oil supply unit configured to supply oil to the space in the casing in which the screw rotor is housed, the oil supply unit having an oil introducing path through which a part of the oil is introduced into the heating fluid passage as the heating fluid.

With such a configuration, a part of oil which is used as a lubrication of the screw rotor and the like can be used as a heating fluid. Accordingly, it is unnecessary to additionally provide a heating fluid supply mechanism other than the oil supply unit and hence, the device can be simplified.

The screw compressor may further include a control part configured to perform control in which the heating fluid is introduced into the heating fluid passage based on a state where a temperature of a gas which flows into the casing from the suction port is lower than a preset reference temperature.

With such a configuration, it is possible to heat oil by introducing a heating fluid at a proper timing at which a temperature of a sucked gas is low so that freezing of the oil is likely to occur and hence, freezing of the oil can be prevented with more certainty.

The screw compressor may further include the slide valve configured to regulate a compression capacity of the screw rotor by sliding in an axial direction of the screw rotor, a position detecting part configured to detect a position of the slide valve in the axial direction and a control part configured to perform control in which the heating fluid is introduced into the heating fluid passage based on a state where a difference between the position of the slide valve detected by the position detecting part and an instructed position of the slide valve exceeds a preset reference value.

When the difference between the actual position of the slide valve (a position detected by the position detecting part) and the instructed position of the slide valve (set position) is large, it is considered that the normal operation of the slide valve is obstructed by freezing of oil in the casing. According to the above-mentioned configuration, oil can be heated by introducing a heating fluid at a proper timing at which the difference between both positions is large so that it is considered that oil is frozen in the casing.

The screw compressor may further include the control part configured to perform control in which the heating fluid is introduced into the heating fluid passage based on a state where a height of a liquid surface of the oil in a container provided for circulating oil between the container and the casing is lower than a preset reference height.

When a height of a liquid surface of oil in the container is low, it is considered that oil is frozen in the casing and hence, the flow of oil from the casing to the container is obstructed. According to the above-mentioned configuration, oil can be heated by introducing a heating fluid at a proper timing at which a height of a liquid surface of oil in the container is low so that freezing of oil in the casing is expected.

The screw compressor may further include the vibration detecting part configured to detect vibration frequency of the casing and a control part configured to perform control in which the heating fluid is introduced into the heating fluid passage based on a state where a difference between the vibration frequency detected by the vibration detecting part and natural vibration frequency of the casing is equal to or more than a preset reference value.

When the vibration frequency of the casing is largely deviated from natural vibration frequency of the casing, it is considered that such a deviation is caused by freezing of oil in the casing. According to the above-mentioned configuration, oil can be heated by introducing a heating fluid at a proper timing at which the deviation of vibration frequency of the casing with respect to natural vibration frequency of the casing is large so that a possibility that oil is frozen in the casing is high.

The embodiments disclosed in this specification should be considered to be in all aspects illustrative and not limitative. The technical scope of the present invention should be understood to be defined not by the description of embodiments given above but by the appended claims and to encompass any modifications in the sense and scope equivalent to those of the appended claims.

This application is based on Japanese Patent application No. 2018-118586 filed in Japan Patent Office on Jun. 22, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A screw compressor comprising:

a screw rotor configured to compress gas due to rotation of the screw rotor about an axis of the screw rotor; and a casing housing the screw rotor rotatably and provided with a suction port for gas, the casing being provided with a suction side space upstream of the screw rotor through which gas flowing into the casing from the suction port flows, the casing being provided with a bearing for the screw rotor, wherein the casing is provided with a heating fluid passage for introducing a heating fluid into the suction side space so as to heat oil staying in the suction side space such that gas, the heating fluid, and the oil are within the suction side space simultaneously, the heating fluid comprises compressed gas from which oil has been separated, and the screw compressor further comprises a gas introducing path through which compressed gas discharged from the screw compressor is introduced into the heating fluid passage as the heating fluid, the gas introducing path being configured to introduce the compressed gas into the heating liquid passage without passing through the bearing.

2. The screw compressor according to claim 1, further comprising an oil supply unit configured to supply oil into a space in the casing in which the screw rotor is housed, the oil supply unit having an oil introducing path through which a part of the oil is introduced into the heating fluid passage as the heating fluid.

3. The screw compressor according to claim 1, further comprising a control part configured to perform control in which the heating fluid is introduced into the heating fluid passage based on a state where a temperature of gas which flows into the casing from the suction port is lower than a preset reference temperature.

4. The screw compressor according to claim 1, further comprising:

a slide valve configured to regulate a compression capacity of the screw rotor by sliding in an axial direction of the screw rotor;

a position detecting part configured to detect a position of the slide valve in the axial direction; and a control part configured to perform control in which the heating fluid is introduced into the heating fluid passage based on a state where a difference between the position of the slide valve detected by the position detecting part and an instructed position of the slide valve exceeds a preset reference value.

5. The screw compressor according to claim 1, further comprising a control part configured to perform control in which the heating fluid is introduced into the heating fluid passage based on a state where a height of a liquid surface of the oil in a container provided for circulating oil between the container and the casing is lower than a preset reference height.

6. The screw compressor according to claim 1, further comprising:

a vibration detecting part configured to detect vibration frequency of the casing; and a control part configured to perform control in which the heating fluid is introduced into the heating fluid passage based on a state where a difference between the vibration frequency detected by the vibration detecting part and natural vibration frequency of the casing is equal to or more than a preset reference value.

7. The screw compressor according to claim 1, wherein the compressed gas used as the heating fluid passes through an oil collector downstream of the screw compressor before being introduced into the heating fluid passage, the oil collector being configured to separate oil from the compressed gas.

8. A screw compressor, comprising:

a screw rotor configured to compress gas due to rotation of the screw rotor about an axis of the screw rotor; and a casing housing the screw rotor rotatably and provided with a suction port for gas, the casing being provided with a suction side space upstream of the screw rotor through which gas flowing into the casing from the suction port flows, wherein the casing is provided with a heating fluid passage for introducing a heating fluid into the suction side space so as to heat oil staying in the suction side space such that gas, the heating fluid, and the oil are within the suction side space simultaneously, the heating fluid comprises compressed gas from which oil has been separated, and the heating fluid passage opens toward the suction side space on a side lower than a lower portion of the screw rotor.

9. The screw compressor according to claim 8, further comprising a gas introducing path through which compressed gas discharged from the screw compressor is introduced into the heating fluid passage as the heating fluid.

10. The screw compressor according to claim 9, further comprising a valve disposed in the gas introducing path and configured to control introduction of the heating fluid from the gas introducing path to the heating fluid passage.

11. A screw compressor, comprising:

a screw rotor configured to compress gas due to rotation of the screw rotor about an axis of the screw rotor; and a casing housing the screw rotor rotatably and provided with a suction port for gas, the casing being provided with a suction side space upstream of the screw rotor through which gas flowing into the casing from the suction port flows, wherein the casing is provided with a heating fluid passage for introducing a heating fluid into the suction side space so as to heat oil staying in the suction side space such that gas, the heating fluid, and the oil are within the suction side space simultaneously, the heating fluid comprises compressed gas from which oil has been separated, and the heating fluid passage extends through a wall of the casing to an outlet disposed at a position inside the casing that is lower than a lowermost portion of the screw rotor.

* * * * *